US005341472A

United States Patent [19]

Leak

[11] Patent Number: 5,341,472

[45] Date of Patent: Aug. 23, 1994

[54] EFFICIENT AREA DESCRIPTION FOR RASTER DISPLAYS

[75] Inventor: Bruce A. Leak, Palo Alto, Calif.

[73] Assignee: Apple Computer, Inc., Cupertino, Calif.

[21] Appl. No.: 898,495

[22] Filed: Jun. 15, 1992

Related U.S. Application Data

[63] Continuation of Ser. No. 474,522, Feb. 2, 1990, abandoned.

[51] Int. Cl.[5] ..... G06F 15/20

[52] U.S. Cl. ..... 395/166

[58] Field of Search ..... 395/133, 155, 161, 162, 395/164, 165, 166; 340/747, 750; 364/200 MS File, 900 MS File; 345/23, 118

[56] References Cited

U.S. PATENT DOCUMENTS 5,226,112 7/1993 Mensing et al. ..... 395/114

5,265,204 11/1993 Kimura et al. ..... 395/166

*Primary Examiner*—Phu K. Nguyen

*Attorney, Agent, or Firm*—Blakely, Sokoloff, Taylor & Zafman

[57] ABSTRACT

An apparatus and method useful for the efficient display of images on a computer display screen a display area description language is provided for describing and manipulating portions of a raster display screen. The area description language is comprised of a set of instructions and masks that define the areas and manipulations for a particular display. The area description language is used to define the location, dimension and contents of areas within a logical display grid. Each area description command is comprised of three components. First, each command has an associated scan count. The scan count defines which scan line or lines will be operated upon by the command. Secondly, each command has at least one instruction. The command instruction is used to define the location and the dimension of the area being defined by the command. The third component that may or may not exist in each command is a mask. The mask is used to define the individual pixels that will be merged with a new source image to create a modified image within the area defined by command instruction.

20 Claims, 9 Drawing Sheets

EFFICIENT AREA DESCRIPTION FOR RASTER DISPLAYS

This is a continuation of application Ser. No. 07/474,522 filed Feb. 2, 1990, now abandoned.

BACKGROUND OF THE INVENTION

1. Field of the Invention

The present Invention relates to an apparatus and method for displaying images on a display screen. Specifically, the present invention relates to an apparatus for generating and manipulating images on a display screen.

2. Prior Art

Computer controlled display devices have become very useful in the computer industry for displaying information to the user. The information displayed to the user can take many forms. For example, it may be useful to display information in terms of alphanumeric characters or in terms of graphic images. In either of these two forms or a variety of other forms, the user seeks to maximize the quantity and quality of information displayed on the display screen, as well as maximizing the speed at which the information is displayed. The quantity and quality of information conveyed to the computer user is increased by use of graphical representations or images on the display screen. Human computer users tend to absorb and manipulate information more quickly when it's presented in a graphical form, rather than an alphanumeric form. The increased use of visual images thus creates a better environment for conveying information to the user. On the other hand, not all information lends itself to display in a graphical form. The optimal computer system needs to be able to manipulate both alphanumeric-type information and graphical information with relative ease.

It has also been determined in the computer industry that the use of color tends to increase the amount of information presented to the computer user. Use of color in an alphanumeric information format can be used to highlight portions of the information displayed on the display screen. For example, a computer system may be devised whereby portions of the screen are displayed in green, indicating the user may alter the information in those areas. Other areas may be displayed in another color, i.e. yellow or red, indicating areas where the user is not allowed to modify the contents of the data. Similarly, the use of color in a graphical image format also facilitates the effective display of information to the user. Just as color photographs convey a better representation of information than black and white photographs, color imagery on the display screen conveys more information to the user than black and white imagery. Thus, the use of multiple display formats and the use of color with those formats provides an effective display capability for conveying large amounts of information to the user.

Unfortunately, the ability to display information in multiple formats and multiple colors comes at the expense of processing time and memory usage. In conventional computer display systems screen images are stored in a large block of memory allocated for the display screen. In this display screen memory, each memory bit (a memory element able to hold a value of one or zero) is mapped to a corresponding picture element (pixel) on the display system. Thus, images and/or text visible on the CRT (cathode ray tube) screen is represented as either a one (black dot) or a zero (white dot) in the block of display screen memory. Ibis type of image representation is known as a bitmap because each bit is mapped one for one to a pixel on the display screen. Although the use of a bitmap is the simplest form of image rendering on a raster type computer display system, the bitmap method has some major drawbacks. For example, on a display screen containing an average size, two-dimension array of pixels (1,000 pixels×1,000 pixels) a million bits of memory (125,000 bytes of memory where each byte is 8 bits) would have to be reserved just for the display screen imagery.

The large memory area necessary for display rendering becomes even greater when the bitmap scheme is used for displaying images in multiple shades of gray or multiple colors. In the traditional black and white display system using a bitmap scheme, each bit is either on or off (white or black). In more sophisticated non-color display systems, each pixel can be displayed as a shade of gray. In these systems, instead of each pixel being represented as a single bit, each pixel must be represented as a collection of bits. The number of bits per pixel depends upon the desired number of shades of gray. For example, in a simple system where two bits were allocated per pixel each pixel could be displayed in one of four gray shade values. One of those values might be used to represent white, another might represent black, and the other two possible values may be used to represent two different shades of gray. As the number of shades of gray per pixel increases the clarity of the images displayed on the display screen increases. However, in a computer display system using a bitmap scheme to display shades of gray the memory allocation necessary to hold the image displayed on the display screen rises dramatically. In the above example of a display system using a 1,000×1,000 pixel display screen array, the memory allocation required for the display screen memory is multiplied by the number of bits used to represent each pixel. Thus, a system providing 8 bits per pixel (thereby providing 256 possible shades of gray per pixel) a 1 million byte memory area would have to be allocated strictly for the display screen.

Rendering color images on a raster type computer display screen can be accomplished in a manner similar to computer systems providing variations in shades of gray. In color systems, each pixel can be represented by more than one bit in memory; but, instead of the multiple bit value representing a shade of gray, the value represents a different color. Typically, an effective rendering of color images requires the use of more bits per pixel than is necessary in a system using multiple shades of gray. It is not uncommon to use at least 8 bits per pixel to render a color image. More desirable is the ability to render an image using 32 bits per pixel. Unfortunately, the implementation of a 32 bit per pixel color display system using a bitmap scheme is less efficient both in terms of the memory consumed and the processing required in order to manipulate a memory area of the size required for the color image. Again, for the above example of a computer display system having a two-dimensional pixel array of 1,000 pixels×1,000 pixels implementing a 32 bit per pixel color scheme would require a memory area of at least 4 million bytes of storage space. Moreover, more processor execution time would be required to process the much larger display memory area. Clearly, a better method is desired in order to render high resolution, multiple color computer display images.

One method for a more efficient rendering of computer display images than is provided by the bitmap scheme is disclosed in the patent titled "Method and Apparatus for Image Compression and Manipulation", (U.S. Pat. No. 4,622,545, inventor William D. Atkinson, filed Sep. 30, 1982. In Atkinson, an apparatus and method is disclosed which provides an improved graphics processing capability. The Atkinson method improves the art over the bitmap scheme by disclosing a method for defining displayed images in terms of inversion points. An inversion point is a point at which the state of all points having coordinates to the right and below the inversion point are inverted (e.g. binary zeroes are converted to binary ones and vice versa). Multiple inversion points can be defined to create any arbitrary area (region) on the display screen. Unlike the bitmap scheme described above, any given region in the Atkinson, scheme can be defined in terms of its inversion points. In Atkinson, all points comprising the region need not be stored in memory. Thus, the Atkinson scheme represents both a savings in memory storage requirements as well as processor execution time.

The Atkinson method provides additional enhancements to the traditional bitmap method of display image generation. Frequently, during the course of using a computer display system, the information presented on the display screen is modified or updated in some form. Often only a portion of the display screen needs to be updated, while other portions of the display screen remain static. Using the bitmap method, it is often difficult to isolate the areas of the screen that change. Typically, an entire source bitmap (new image being used for update) must be processed and the entire screen bitmap must be regenerated at considerable expense in terms of processor execution time.

Atkinson provides a method for operating on regions (or portions thereof) within computer memory and for displaying a resulting region on the display screen. Since portions of memory associated with the display screen can be specified using inversion points to define regions, individual regions can be targeted for update while other regions are left unmodified. The Atkinson method of using lists of inversion points to define regions provides a means for representing the contents of each raster scan line on the display screen. A raster scan line is a horizontal row of pixels on the display screen from the left edge of the screen to the right edge of the screen. In display systems where one bit in memory represents one pixel on the display screen, one raster scan line may be represented in memory by a collection of bits in a scan line buffer, which represents the entire raster scan line of pixels. Thus, regions in the Atkinson scheme are horizontally sliced into a scan line buffer corresponding to a single raster scan line. A particular region is updated by transferring the scan lines associated with the region (source bitmap) to a destination bitmap after applying a mask to each scan line. Using masks, selected portions of the source bitmap are transferred to the destination bitmap.

While the Atkinson method does provide an improved scheme over the traditional bitmap method, the inversion point and masking method in Atkinson can be further improved. The Atkinson scheme works well for display systems where one pixel is represented by a single bit in memory. In these systems, only a single one bit per pixel scan line mask is required per scan line. However, as described earlier, more powerful display systems employ multiple bits per pixel. For color display systems, at least 8 bits per pixel are required, yet 32 bits per pixel or more may be used. In a 32 bit per pixel display system using the Atkinson method, each scan line would require a distinct 32 bit per pixel scan line mask. As the size and number of regions increases, the memory requirements and processing power required to manipulate the regions would become greater than may be available in smaller computer systems.

As discussed below, the present invention provides a method and an apparatus for describing and manipulating areas in the frame buffer of raster display systems. Specific display areas can be manipulated without affecting other areas of the display screen. The present invention facilitates the use of multiple bits per pixel while reducing the processing time required to process the images displayed on the screen. Additionally, the present invention allows the use of prior methods, such as the traditional bitmap scheme or the improved Atkinson masking scheme in order to maintain compatibility with prior systems.

SUMMARY OF THE INVENTION

The present invention provides an apparatus and method useful for the efficient display of images on a computer display screen. The present invention improves the methods of the prior art by providing a display area description language capable of defining any arbitrary area on a raster display screen.

The present invention provides a display area description language useful for describing and manipulating portions of a raster display screen. The area description language is comprised of a set of instructions and masks that define the areas and manipulations for a particular display. The area description language is particularly useful in that it can be used in display systems where one bit of memory represents a single pixel or in display systems where multiple bits of memory represent each pixel. The concept of applying multiple bits of memory to each pixel is known as image depth. As discussed earlier, better image quality can be obtained by using greater image depth to render images in color or in multiple shades of gray. In the present embodiment, a 32-bit image depth is most efficient over the prior art, since the efficiency of the present invention is proportional to the depth of the image. The use of image depths of 1, 2, 4, 8, 16, 32, and 64 bits per pixel is provided by the present invention. Typically, better efficiency is achieved as the image depth is increased.

In the present embodiment, the display screen is logically divided into a grid. The horizontal dimension of this logical grid is defined by dividing the display screen horizontally into multiple groups of memory bits; each group comprising 32 bits. Each group of memory bits can be used to represent 32 pixels at one bit per pixel. Equivalently, each group of memory bits can be used to represent a single pixel at an image depth of 3,2 bits per pixel. The display screen is divided vertically by 1-pixel scan lines.

The horizontal 32 bit groupings of bits exploits the better efficiency provided by a computer operating on a quantity of bits compatible with the register length and instruction set of a particular processor. In the present embodiment, the processor is most efficient when used in operating on a group of 32 bits. This group of 32 bits is called a long word. Since a 32 bit long word is the most efficient entity, the area description language in the present embodiment is described in terms of long words (computer words). Other word lengths can also be used with the methods provided by the present invention. For example, bit groupings of 2,4,8, 16, 64, and 128 bits per word may also be used.

The area description language is used to define the location, dimension and contents of areas within the logical display grid. Prior to drawing an image on the display screen, the processor reads the memory area containing the area description language commands and interprets the commands one by one, in order to create a displayable image.

Each area description command is comprised of two components. First, each command has an associated scan count. The scan count defines which scan line (or lines) wig be operated upon by the command. Secondly, each command has an instruction stream. The instruction stream contains at least one instruction, and typically, a set of instructions. The area defined by the instruction stream describes a number of long words in a destination image buffer (frame buffer) upon which the instructions will operate. Each instruction of the instruction stream may optionally contain one or more masks. The mask(s) is used to define the individual pixels within each affected long word that will be merged with a new source image to create a modified image within the groupings defined by the instruction. Not every instruction is required to have a mask(s).

Each area description language instruction in the present embodiment is a 32 bit long word comprised of four fields. The first field is a stop field. The stop field defines whether or not the processing for the current scan line has been completed. The stop field may equivalently be implemented as an instruction count field that defines the number of words or the number of instructions in the instruction stream. The next field is a mask control field. The mask control field defines whether or not masks follow the current instruction. If so, they will be applied to frame buffer memory, thereby selectively changing the display image. A source image may be used with the masks to selectively change the display image. The third field is a count field. This field defines the number of long words that this instruction will affect in frame buffer memory and the number of masks that follow this instruction, if there are any. The fourth field for each instruction is a skip field. The skip field defines the number of long words that are passed over and left unmodified in the current scan line.

During the process of creating or modifying a displayed image the processor reads and interprets the commands located in a block of memory called the area description buffer. Similarly, the processor also reads data from a source image. The source image contains the image, or a portion of an image, that will be merged into the currently displayed image in the frame buffer. The image currently displayed on the display screen is stored in a frame buffer or destination image. For each display update cycle, the display processor reads and interprets the instructions from the area description buffer, reads the data from the source image, and applies the new data to the frame buffer, thereby causing the new image to be displayed on the display screen. The commands in the area description buffer define the locations and dimensions of the data taken from the source image and applied to the frame buffer. Similarly, the masks associated with each instruction in the area description buffer define the manner in which the data bits from the source image are actually applied to the frame buffer. The display processor cycles through each command in the area description buffer and applies the modifications for each scan line with an associated command. In this way new images can be quickly and efficiently manipulated on the raster display screen.

DETAILED DESCRIPTION OF THE INVENTION

The present invention relates to a method and an apparatus for describing and manipulating areas in raster display systems. The following detailed description describes the present invention in the preferred embodiment of a digital computer system. The apparatus for performing the methods and operations of the present invention may be a general purpose computer system, or a specialized graphics display system, or other similar device. The processes of the present invention are not inherently limited to any particular computer or other apparatus.

Figure 1:
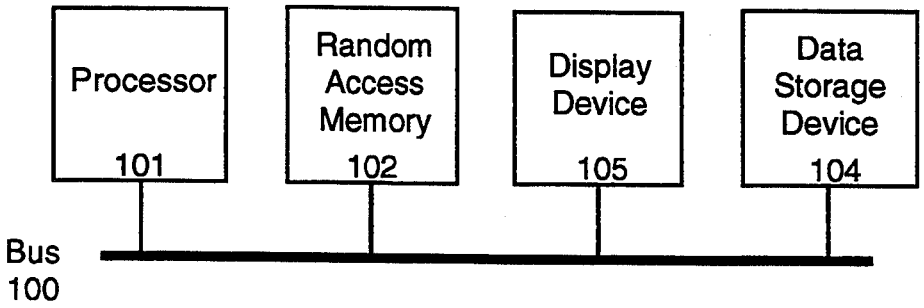
FIG. 1 illustrates a computer incorporating the present invention.

The preferred embodiment of the present invention is implemented on an Apple Macintosh TM computer system manufactured by Apple Computer, Inc. of Cupertino, Calif. As understood by those of ordinary skill in the computer art, alternative computer systems may be employed. In general, such computer systems, as illustrated by FIG. 1, comprise a bus 100 for communicating information, a processor 101 coupled with said bus for processing information, a random access memory 102 coupled with said bus 100 for storing information and instructions for said processor 101, a data storage device 104, such as a magnetic disk and disk drive coupled with said bus 100 for storing information and instructions, and a display device 105 coupled to said bus 100 for displaying information to the computer user.

The display device 105 may contain cathode ray tube (CRT) or other suitable raster display device. Display devices in the present embodiment typically display images on a screen using a raster technique. The raster technique, commonly known in the computer art, is a method whereby the two dimensional display area is divided into discrete points or pixels. In a less complicated display device, each pixel can be independently turned on (lit) or off. In the display device of the present embodiment, each pixel can be independently turned on or off, displayed as a shade of gray, or displayed in multiple colors.

In order to display images using the raster technique, the display system sequentially scans the pixels from left to right, and top to bottom down the display screen. In order to determine which pixels are lit, and if lit, which color or shade of gray, the display processor accesses a frame buffer. The frame buffer 200 is a large block of random access memory, shown in FIG. 2, which defines the manner in which the pixels are currently displayed on the display screen. In a less sophisticated display device, each bit in the frame buffer 200 corresponds one for one with a pixel on the display screen. In the more sophisticated display device of the present embodiment, 32 bits of memory in the frame buffer 200 can be used to describe a single pixel on the display screen. Similarly, groupings of 2, 4, 8, 16, 64, or 128 bits of frame buffer 200 memory can be used to describe a single pixel. Once frame buffer 200 memory is set up properly to display the desired image, the frame buffer controller 301, shown in FIG. 3, can efficiently read the data from the frame buffer 200 and scan the array of pixels on the display screen 302, thereby displaying the desired image. The present invention is particularly useful in properly setting up the frame buffer 200 contents. The detailed features and implementation of the present invention in the preferred embodiment are described in the following section. The general operation of raster display systems is described only where necessary to provide a thorough understanding of the present invention, since these methods are familiar to those of ordinary skill in the computer art.

Operation of the Present Invention

Figure 2:
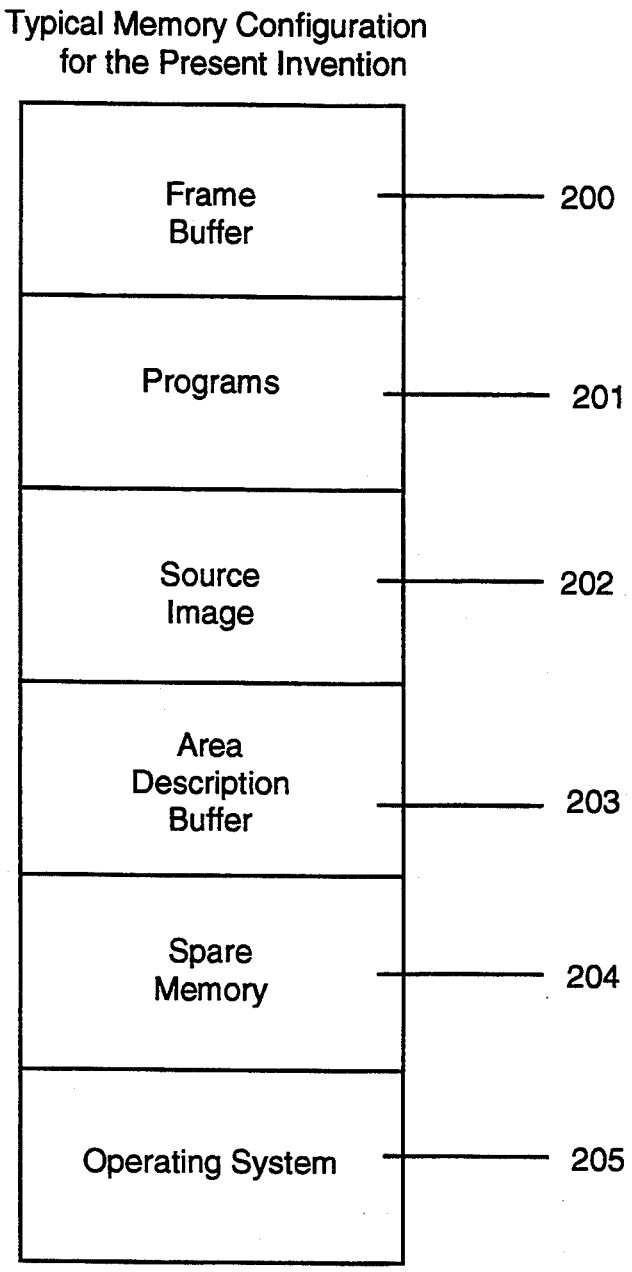
FIG. 2 illustrates a typical memory configuration for the present invention.
Figure 3:
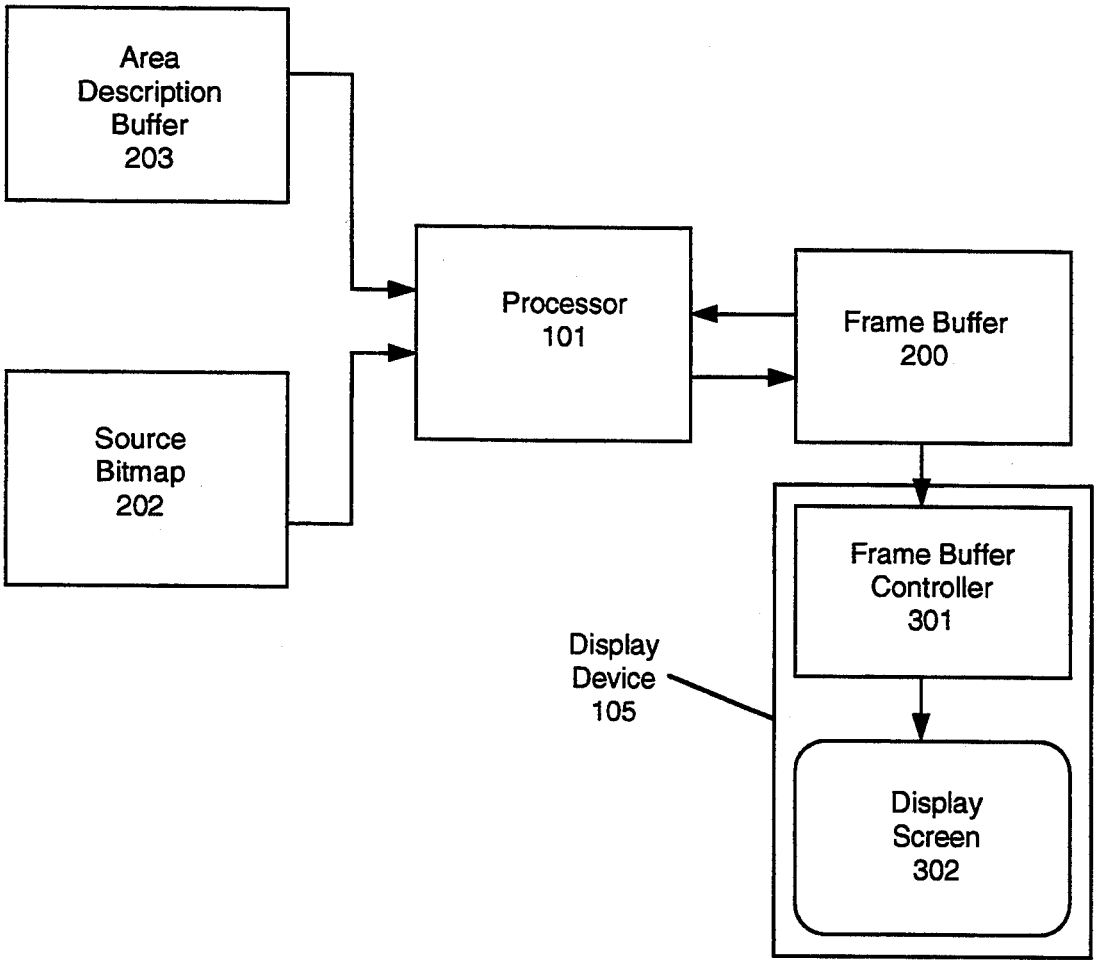
FIG. 3 illustrates the processor and display in relation to the memory buffer contents.

The present invention represents images on the display screen 302 using a set of area description commands (instructions and masks) that define the areas and manipulations for a particular display. The area description commands are located in an area of memory called the area description buffer 203, as shown in FIG. 2. Also stored in random access memory is a source image 202. The source image 202 is a collection of image data from which the processor 101 takes images and merges those images into the frame buffer 200 in compliance with the commands in the area description buffer 203. In this way, images or regions in the frame buffer 200 can be modified, thereby modifying the image displayed on the display screen 302.

Figure 4B:
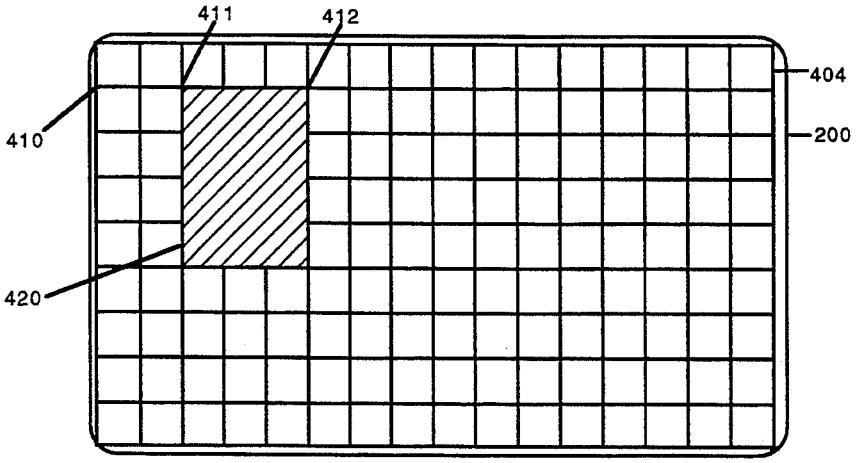
Figure 5A:
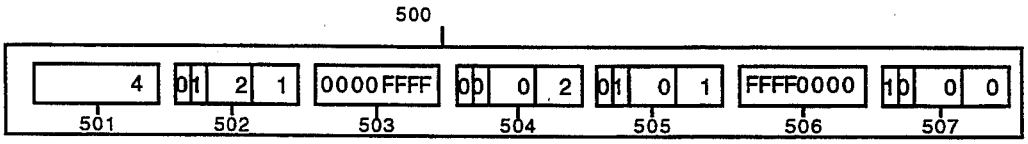
Figure 5B:
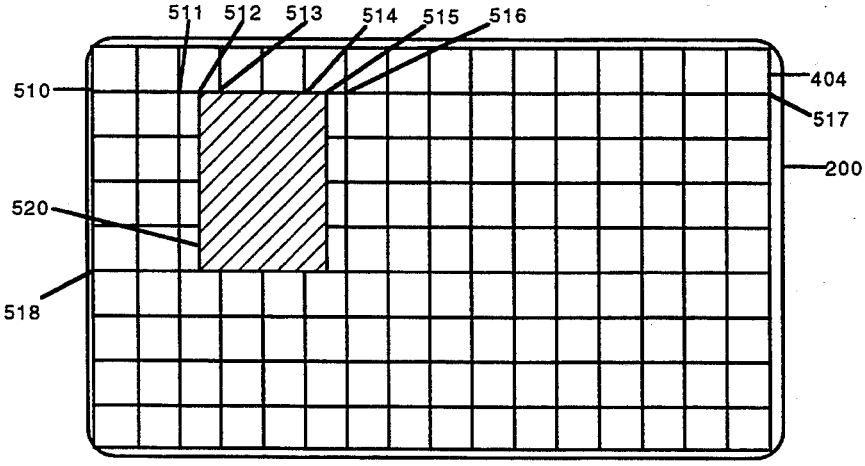
Figure 6A:
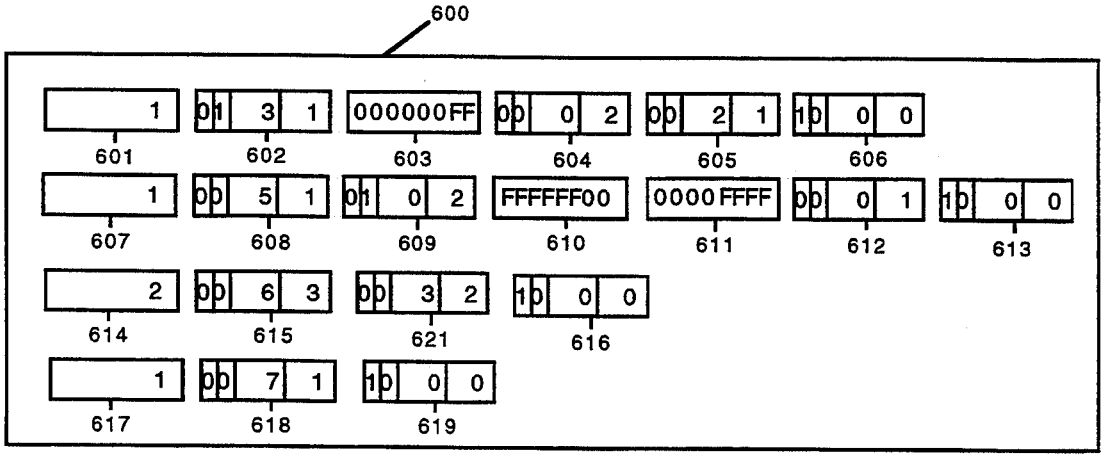
Figure 6B:
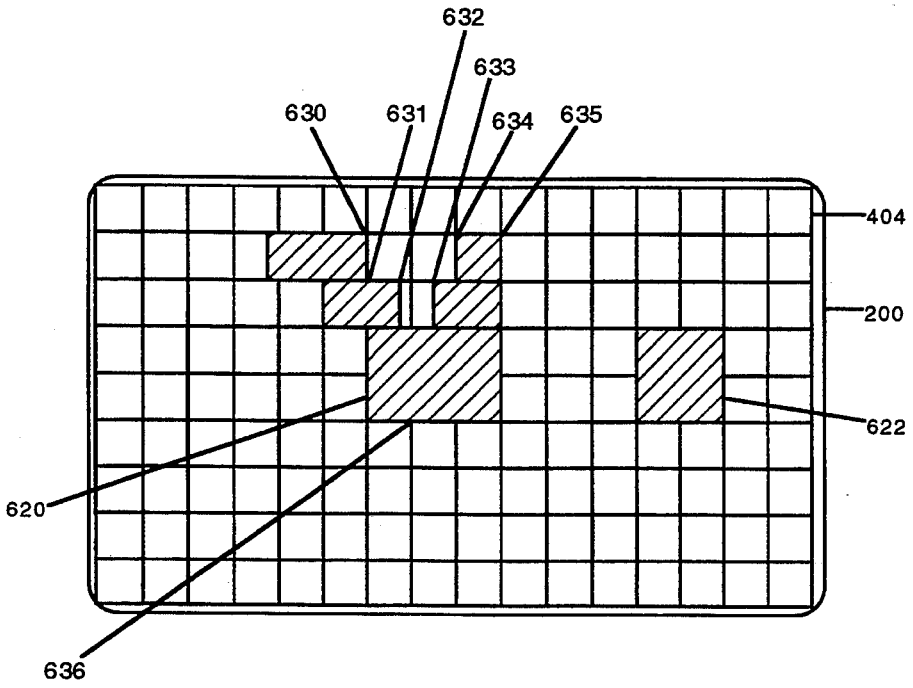

The area description commands identify regions in the frame buffer 200 using a grid system 404. The implementation of this grid system is depicted in FIGS. 4*b*, 5*b*, and 6*b* . The grid system 404 logically divides the display screen 302 horizontally into multiple groups of 3:2 bits per group. Other groupings could equivalently be used, such as 2, 4, 8, 16, 64, and 128 bits per group. The display screen 302 is then divided vertically by scan lines.

In FIG. 4*b*, an arbitrary region 420 is superimposed on the grid system 404. In this case, the arbitrary region 420 is a rectangular region. The rectangular region 420 in this example is aligned with the vertical and horizontal grid 404 at points 411 and 412. This example is in contrast to the example of an arbitrary region 520 shown in FIG. 5*b*, where both the left hand borders and the right hand borders are not aligned along the grid 404 lines. Since the horizontal grid 404 lines are positioned on scan lines, it would not normally be possible to position an image between the horizontal lines of the arid 404.

Referring back to FIG. 4*a*, FIG. 4*a* illustrates the area description command 400 used to describe the rectangular region 420 superimposed and aligned with the grid 404 shown in FIG. 4*b*. Similarly, FIG. 5*a* illustrates the area description command 500 used to describe the unaligned rectangular region 520 shown in FIG. 5*b*. Any other arbitrary region of any size, shape or location on the display screen 302 can be similarly represented by area description commands. Multiple areas may also be represented by use of the area description commands of the present invention. The multiple areas need not be contiguous.

Each area description command is comprised of two components. First, each command has a scan count. The scan count defines which scan line (or lines) will be operated upon by the area description command. Since the horizontal grid lines in the grid 404 system correspond to scan lines, the scan count is also used to define which horizontal grid 404 line or lines upon which the command will operate. Secondly, each command has an instruction stream. The instruction stream contains at least one instruction, and typically, a set of instructions. The area defined by the instruction stream describes a number of long words in a destination image buffer (frame buffer) upon which the instructions will operate. Each instruction of the instruction stream may optionally contain one or more masks. The mask(s) is used to define the individual pixels within each affected long word that wig be merged with a new source image to create a modified image within the groupings defined by the instruction. Not every command is required to have a mask(s).

Each instruction in the area description language is comprised of four fields. The first field is a stop field. The stop field defines whether or not the processing for the current scan line has been completed. The stop field may equivalently be implemented as an instruction count field that defines the number of words or the number of instructions in the instruction stream. The second field is a mask control field. The mask control field defines whether or not masks follow the current instruction. If so, they will be applied to frame buffer memory, thereby selectively changing the display image. A source image may be used with the masks to selectively change the display image. The third field is a count field. This field defines the number of long words that this instruction will affect in frame buffer 200 memory and the number of masks that follow the current instruction. The fourth field for each instruction is a skip field. The skip field defines the number of long words that are passed over and unmodified in processing the current scan line.

Figure 4A:
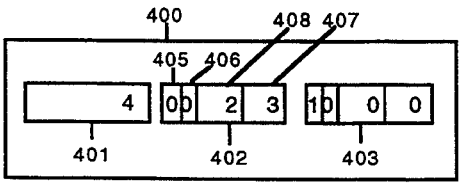
FIGS. 4*a*, 5*b*, 5*a*, 6*a*, and 6*b* illustrate the use of the area description method to define regions.

For the example in FIG. 4*a*, the scan count field 401 contains a value of four indicating that the area description command 400 applies to the next four scan lines. The area description command 400 in FIG. 4*a* contains two instructions. In the first instruction 402, the stop field 405 (the leftmost field) is zero, indicating that more instructions will follow that describe the scan line(s). The mask control field 406 for the first instruction 402 is also a zero, indicating that no masks are required for this instruction. No masks are required, since the region m grid 404 is aligned and no other masks are used.

The skip field 408 in the first instruction 402 holds a value of two indicating that two long words should be skipped in processing the current scan line. In FIG. 4*b*, the separation between points 410 and point 411 account for the skip of two long words specified by the skip field 408 in the first instruction 402. The frame buffer column pointer and the source image column pointer are updated to correspond to the number of long words skipped. The skip field 408 can be used to specify the exterior regions of the area being described.

The count field 407 of the first instruction 402 contains a value of three indicating that the next three long words are wholly contained within the region. Referring again to FIG. 4*b*, the distance between point 411 and point 412 is three long words corresponding to the value held by the count field 407 of the first instruction 402. The count field 407 can be used to specify the interior regions of the area being described.

In the second instruction 403 of FIG. 4a, the stop field holds a value of one indicating that processing for the current scan line is complete. The remaining fields of the second instruction 403 are set to zero, since these fields are ignored when the stop bit is set to a one. If the stop bit is set to a one, processing of the current scan line terminates leaving the remaining portion of the scan line in the exterior of the area defined. Therefore, the area description command 400, shown in FIG. 4a, can be used to completely describe the area 420 shown in FIG 4b. Since the area 420 is aligned with the grid system on both the left hand and right hand borders, no masking is required in the area description command 400. No partial longwords are contained in the area.

In the example of FIGS. 4a and 4b (and the following examples), the area description is independent of image depth. For an image depth of one bit per pixel with 32 bits of memory representing the distance between vertical grid lines 404, the area 420 in FIG. 4b is 96 pixels wide (32×3). Equivalently, for an image depth of 32 bits per pixel, the area 420 in FIG. 4b represents only three pixels. In either case, however the area description remains the same.

In an equivalent embodiment, a pixel color instruction may be provided in the area description command itself. The color instruction can be used to define a color or shade of gray for each of the pixels in the region 420.

FIG. 5a shows an example of an area description command 500 for a region 520 not aligned with the grid system 404 on either the left hand or right hand borders as shown in FIG. 5b. FIGS. 5a and 5b thus present masking features in the area description language of the present invention. In FIG. 5a, the area description command 500 is used to describe the unaligned region 520 shown in FIG. 5b. The scan count 501 contains a value of four again indicating that the region 520 spans a vertical distance of four scan lines. Following the scan count 501 the area description command 500 contains four instructions (502, 504, 505, and 507) and two masks (503 and 506). In the first instruction 502, the stop bit is set to a zero, indicating that additional instructions will follow. The skip field in the first instruction 502 contains a value of two indicating that two long words are skipped in the current scan line. The skip indicated by the first instruction 502 corresponds to the distance between points 510 and 511 in FIG. 5b. The skip field can be used to horizontally displace the area being described in increments of full long words.

Since the area between points 511 and 513 contain both interior and exterior regions of the area, a mask is required. The use of a mask is specified by the mask control field, which is set to a value of one in the first instruction 502. The mask control field indicates that a mask or set of masks follow the current instruction. With the mask control field set to a one, the count field is used to specify the number masks that follow the current instruction. In the example of FIG. 5a, the count field of the first instruction 502 contains a value of one, indicating that a single mask follows the first instruction 502. This mask 503 is used to define the region between points 511 and point 513.

The mask itself 503 is a long word containing a binary value (shown in hexidecimal) indicating the portions of the region 520 that are interior to the area or exterior to the area being described. Bits in the mask that are set to a zero indicate exterior regions. Mask bits that are set to a one indicate interior regions of the area being described. In the example of FIG. 5b, the region between point 511 and point 512 is an exterior region indicated by the zeros in the upper half of the mask. The region between points 512 and 513 is an interior region indicated by the bits set to a one in the lower half of the mask 503 (FFFF is the hexadecimal representation for a binary value where 16 bits are set to one). The region between points 511 and 512 is an exterior region indicated by the bits set to a zero in the upper half of the mask 503.

The second area description instruction 504 in the example of FIG. 5a is used to describe the region between point 513 and point of FIG. 5b. The stop bit is set to a zero in instruction 504 indicating that further instructions follow. Similarly, the mask control field is set to a zero to indicate that no masks follow this instruction 504. The skip field is also set to zero indicating that point 513 is not displaced to the right by any number of long words. The count field is set to two, indicating that two long words of interior extend between point 513 and point 514.

The region between point 514 and point 516 is defined by the instruction 505 and the mask 506. Regarding the instruction 505, again the stop bit is set to zero indicating further instructions follow. The skip field is set to zero indicating that no long words are skipped from the current location. The mask control field in instruction 505 is set to one indicating that a mask follows this instruction 505. The count field is set to one indicating that a single mask 506 follows the instruction 505.

The mask 506 specifies the interior and exterior regions from point 514 to point 516. The upper half of the mask 506 is set to all ones (FFFF) indicating that the region between point 514 and point 515 is an interior region. The lower half of the mask 506 is set to zeros indicating that the region between point 515 and point 516 is an exterior region.

Instruction 507 completes the area description command 500 by setting the stop bit to one indicating that processing for this scan line is complete. As with the example in FIGS. 4a and 4b, the instructions and masks in the area description command 500 extend for the next four scan lines as indicated by the value of four in the scan count 501.

The area description language can be used to represent any arbitrary region that can be displayed on a raster-type display screen. The example in FIGS. 6a and 6b shows an arbitrary shape and the associated area description commands used to describe that shape. FIG. 6b illustrates a more complex arbitrary region 620 and the associated area description commands 600 used to represent the region 620 as shown in FIG. 6a. The example in FIGS. 6a and 6b shows the use of an instruction with more than one mask and the use of commands spanning variable numbers of scan lines.

The processes of the present invention can be used to develop a set of area description commands for describing a new region or for translating an existing image into a set of area description commands. Thus, the methods of the present invention can be used to create a translator capable of translating existing images into area description command sets.

The previous examples were presented with an image bit groupings of 32 bits. Similar implementations can be performed using the processes of the present invention with groupings of 2, 4, 8, 16, 64, or 128 bits per pixel. In this manner, a color or shade of gray may be defined for pixels within a region. The area description language with these various groupings would be implemented in the same way as the examples of FIGS. 4*a*, 5*a*, and 6*a*.

The present invention is efficient for any system where the bit grouping used is an integer multiple of image depth. In the preferred embodiment of the present invention, bit groupings of powers of 2 have been used; but, such bit groupings are not limited thereto.

Processing Logic for the Present Invention

The present invention includes computer program logic for processing the area description commands. This logic is described in the following section and in FIGS. 7–10.

When the computer system of FIG. 1 is first initialized, operating system logic 205 receives control and initializes the computer system components,, such as random access memory 102, the data storage device 104, and the display device 105. The use of an operating system 205 is a well known technique in the computer art. The operating system 205 initially loads random access memory 102 in a memory configuration as shown in FIG. 2. The initial contents of the frame buffer 200, the source image 202, and the area description buffer 203 may be obtained from the data storage device 104. At the end of the operating system initialization cycle, the operating system 205 transfers control to the processing logic of the present invention for processing of the area description commands stored in the area description buffer 203.

Figure 7:
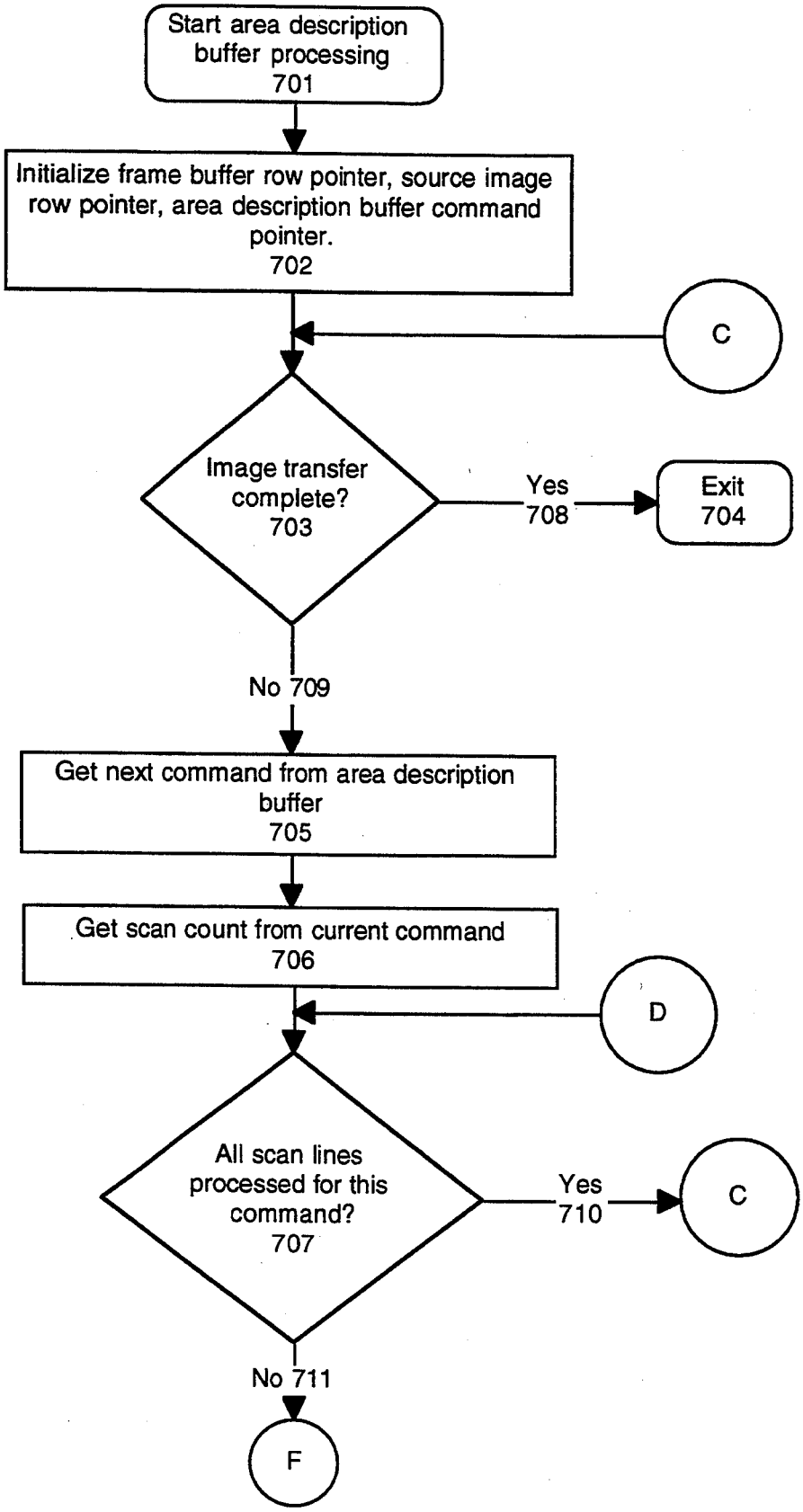
FIG. 7–10 are flowcharts illustrating the processing logic for the present invention.

Once the processing logic of the present invention is activated, the processing flow begins as shown in FIG. 7 at the box labeled "Start Area Description Buffer Processing" 701. First, a frame buffer row pointer, a source image row pointer and an area description buffer command pointer are initialized 702. Next, a test 703 is performed to determine if the frame buffer 200 has been completely processed or if the image has been completely transferred from the source image 202 to the frame buffer 200. This test 703 is performed by comparing the index of the last scan line in the source image 202 with the index of the scan line currently being processed by the processing logic of the present invention. If the result of this test 703 is true (processing path 708), the processing logic terminates normally 704 and returns control back to the operating system.

If the image transfer is not complete (processing path 709), the next command from the area description buffer is fetched 705. The command is fetched using the area description buffer command pointer, which points to the current location in the area description buffer 203 currently being processed. The form of the commands in the area description buffer is similar to the form of the commands presented in the examples of FIGS. 4*a*, 5*a*, and 6*a*. Once the command is fetched from memory the scan count from the current command is extracted 706. Since a single command in the present invention can operate on more than one scan line, a test 707 is performed to determine whether or not all of the scan lines specified in the scan count have been processed. The test 707 is accomplished by maintaining a counter (initialized to the scan count extracted from the current command 706), which is decremented each time a command is applied to a new scan line. If all scan lines have been processed for this command (processing path 710), processing control is transferred to C in FIG. 7 where a new command is fetched from the area description buffer. If the current command needs to be applied to the current scan line (processing path 711), processing continues at F in FIG. 8.

Figure 8:
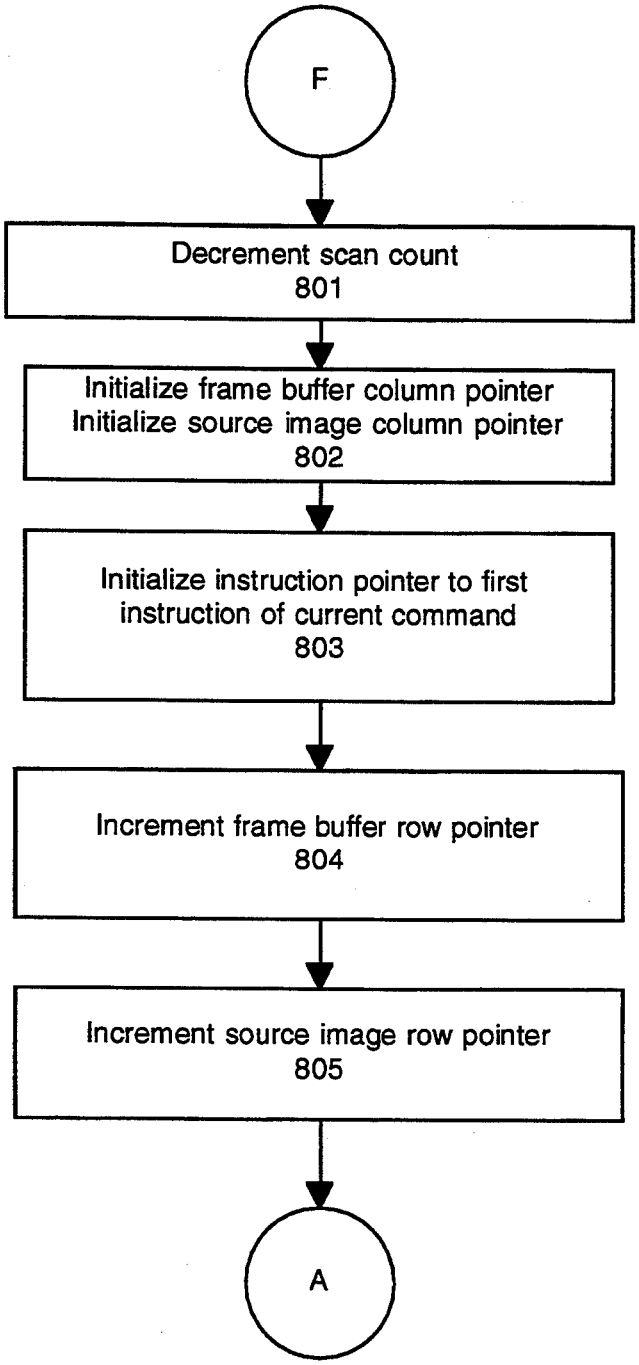

Starting at F in FIG. 8 the scan counter is decremented 801. Next, the frame buffer column pointer and the source image column pointer are initialized 802 to the left-hand edge of the display or the left-hand edge of the image. Next, the instruction pointer is initialized 803 to point to the first instruction of the current command. The frame buffer row pointer and the source image row pointer are both incremented 804, 805. Control transfers to A in FIG. 9.

Figure 9:
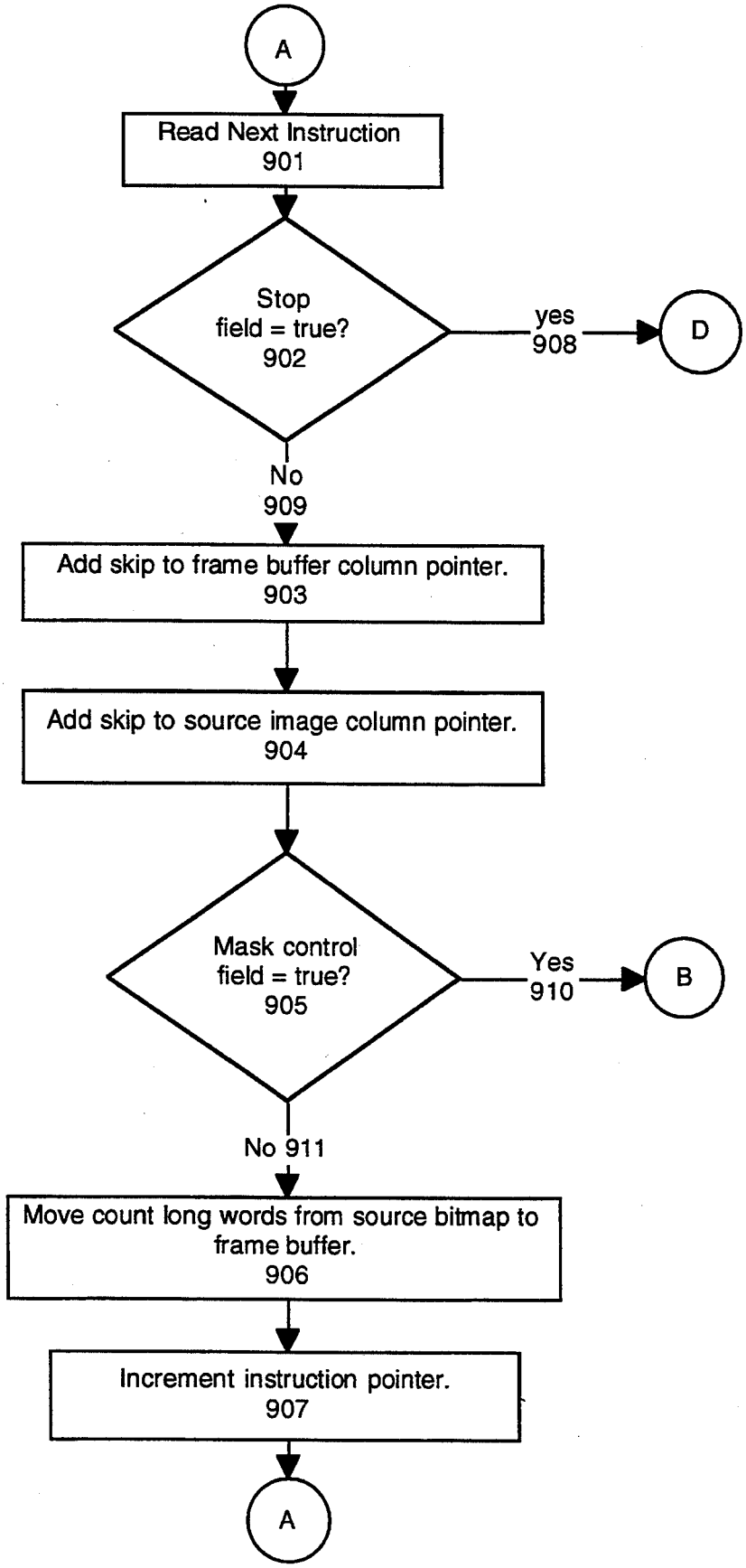

Starting at A in FIG. 9, the next instruction of the current command is fetched 901. The stop field of the fetched instruction is extracted and tested 902 for a true value. If the stop field is true (processing path 908), control is passed to D in FIG. 7 where processing continues with a new scan line. If the stop field of the current instruction is not true (processing path 909), the skip field from the current instruction is extracted and added 903 to the frame buffer column pointer and added 904 to the source image column pointer.

The mask control field is extracted from the current instruction. If the mask control field is true (processing path 910), control is transferred to B in FIG. 10 where the masks following this instruction are processed. If the mask control field is false (processing path 911), the count field of the current instruction is interpreted as the number of long words to be moved from the source image 202 to the frame buffer 200. Thus, when the mask control field is false (processing path 91 1), the count field is extracted from the current instruction and the number of long words specified by the value in the count field are moved 906 from the source image 202 to the frame buffer 200. The frame buffer column pointer and the source image column pointer are updated to correspond to the number of long words moved to the frame buffer 200. Next, the instruction pointer is incremented 907 to point to the next instruction in the current command. Control loops back to A in FIG. 9 where the next instruction for the current command is processed. The process of reading and performing instructions is repeated until an instruction is found with the stop field set to a true value (processing path 908). If the mask control field of the current instruction is a true value (processing path 910), control is transferred to B in FIG. 10.

Figure 10:
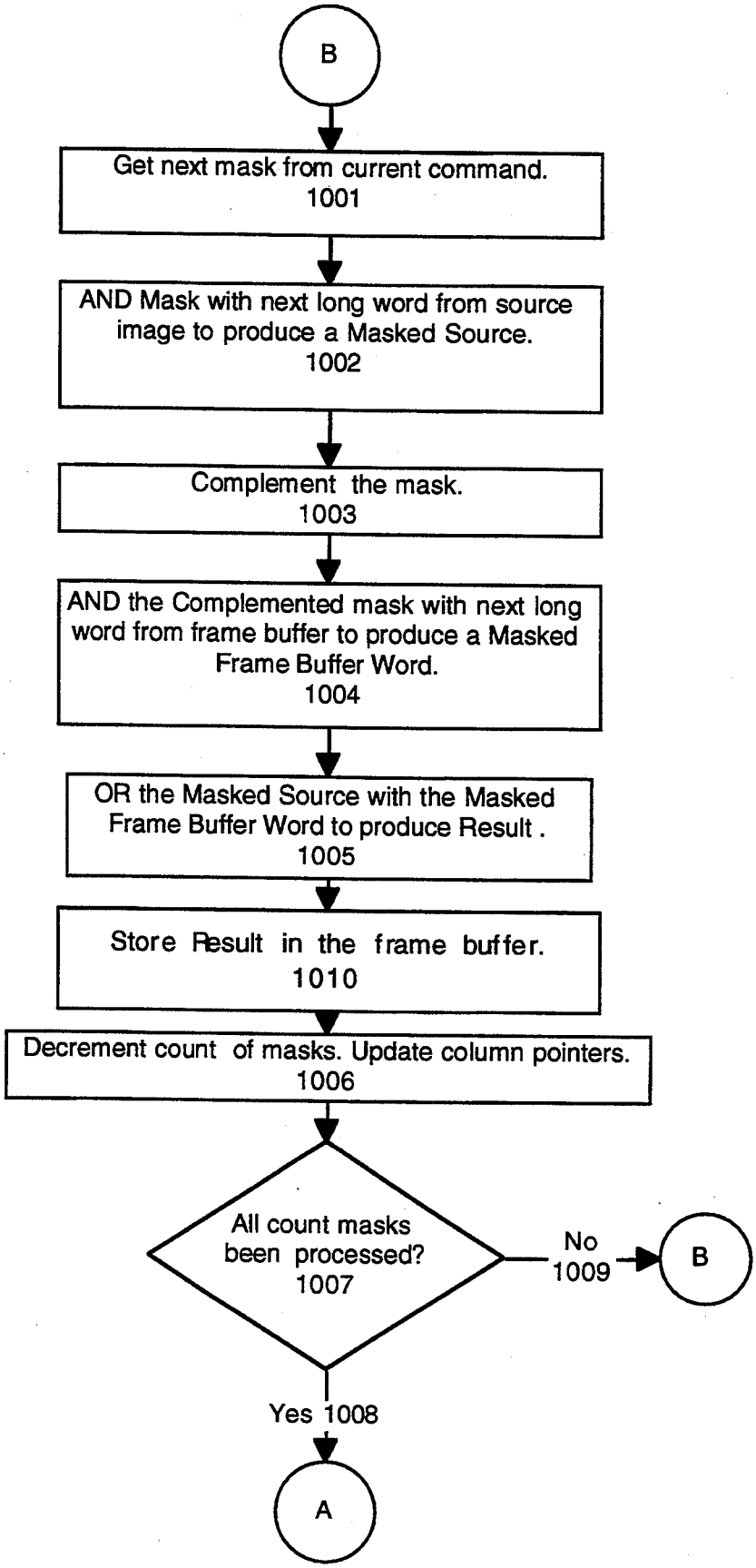

Starting at B in FIG. 10, the masks following the current instruction are processed. First, a mask is fetched 1001 from the current command. Next, the mask is logically ANDed 1002 with the next long word from the source image 202 to produce a Masked Source. The mask is then complemented 1003. Next, the complemented mask is logically ANDed 1004 with the next long word from the frame buffer 200 to produce a Masked Frame Buffer Word. Next, the Masked Source is logically ORed 1005 with the Masked Frame Buffer Word to produce a Result. The Result is stored 1010 in the frame buffer 200. The process of fetching masks from the current command and using logical operations to apply image data to the frame buffer 200 is repeated for as many masks as specified by the contents of the count field. The frame buffer column pointer and the source image column pointer are updated to correspond to the number of masks applied to the frame buffer 200. Following each iteration of the cycle, the value from the count field is decremented 1006. The count value is then tested 1007 for zero. If the count value is zero (processing path 1008), all count masks have been processed. If this is not the case (processing path 1009), control is transferred back to B in FIG. 10 and the cycle repeats for the next mask. Once all masks associated with the current instruction have been processed (processing path 1008), control is transferred back to A in FIG. 9 where the next instruction is fetched from the current command. Each of the commands in the area description buffer are processed as described until the image has been completely transferred (processing path 708) from the source image 202 to the frame buffer 200.

Although this invention has been shown in relation to a particular embodiment it should not be considered so limited. Rather, it is limited only by the appended claims.

What is claimed is:

1. In a computer controlled display system, a process for specifying and manipulating regions of a graphic representation, said process comprising the steps of:

providing a frame buffer having a plurality of memory locations containing image data, said image data being data bits corresponding to a plurality of displayable picture elements (pixels), each of said plurality of memory locations further including at least one bit location, each bit location containing one data bit of image data;

providing an area description command, said area description command being information specifying a location and size of a frame buffer region in said frame buffer and specifying manipulations to said frame buffer region, said location of said frame buffer region being specifiable at any said bit location in said frame buffer, said area description command including a scan count and an instruction stream, said scan count indicating at least one scan line in said frame buffer, the scan line being operated on by said area description command, said instruction stream having at least one graphic instruction, said graphic instruction comprising a first group of bits, said first group of bits being an encoded representation of a second group of bits located in said frame buffer region, said first number of bits being less than said second number of bits;

reading and interpreting said area description command; and modifying the contents of said frame buffer in accordance with said area description command.

2. The process of claim 1 wherein said step of reading and interpreting said area description command comprising the steps of:

reading and interpreting said scan count residing within said area description command; and reading and interpreting said instruction stream, said instruction stream including said graphic instruction residing within said area description command.

3. The process of claim 1 wherein said step of reading and interpreting said instruction stream further comprising the steps of:

reading and interpreting a stop field in said graphic instruction, said stop field specifying when processing for said area description command is complete;

reading and interpreting a mask residing within said graphic instruction if said graphic instruction requires said mask;

reading and interpreting a mask control field in said graphic instruction, said mask control field specifying when said mask is required by said graphic instruction;

reading and interpreting a count field in said graphic instruction, said count field being interpreted as a mask count if said mask control field is set to a corresponding value; and reading and interpreting a skip field in said graphic instruction, said skip field specifying a number of frame buffer memory locations to skip without manipulation.

4. The process of claim 2 wherein said step of reading and interpreting said instruction stream further comprising the steps of:

reading and interpreting a stop field in said graphic instruction, said stop field specifying when processing for said area description command is complete;

reading and interpreting a mask control field in said graphic instruction, said mask control field specifying when a mask is required by said graphic instruction;

reading and interpreting a count field in said graphic instruction, said count field being interpreted as a mask count if said mask control field is set to a corresponding value; and reading and interpreting a skip field in said graphic instruction, said skip field specifying a number of frame buffer memory locations to skip without manipulation.

5. The process of claim 2 wherein said step of reading and interpreting said instruction stream further comprising the steps of:

reading and interpreting a stop field in said graphic instruction, said stop field specifying when processing for said area description command is complete;

reading and interpreting a count field in said graphic instruction, said count field specifying a number of frame buffer memory locations to transfer from a source region to said frame buffer; and reading and interpreting a skip field in said graphic instruction, said skip field specifying a number of frame buffer memory locations to skip without manipulation.

6. The process of claim 1 wherein said step of modifying the contents of said frame buffer further comprising the steps of:

reading the contents of a source region in a source image buffer, said source region being defined by said area description command; and merging the contents of said source region into said frame buffer region in said frame buffer, said step of merging performed in accordance with said area description command, said step of merging not affecting other areas not within said frame buffer region.

7. The process of claim 6 wherein said step of merging the contents of said source region into said frame buffer region further comprising the steps of:

reading the contents of said frame buffer region;

reading said mask from said area description command;

transferring bits from said source region to said frame buffer region only where corresponding bits in said mask are set to a true value.

8. The process of claim 6 wherein said step of merging the contents of said source region into said frame buffer region further comprising the step of:

transferring the contents of a number of memory locations from said source region to said frame buffer, said number corresponding to a count field residing within said area description command.

9. The process of claim 1 wherein said area description command further including an instruction count, said step of reading and interpreting said area description command further comprising the steps of:

reading and interpreting said scan count residing within said area description command;

reading and interpreting said instruction count residing within said area description command; and reading and interpreting said instruction stream, the number of graphic instructions in said instruction stream corresponding to said instruction count.

10. The process of claim 9 wherein said step of reading and interpreting said instruction stream further comprising the steps of:

reading and interpreting a mask residing within said graphic instruction if said graphic instruction requires said mask;

reading and interpreting a mask control field in said graphic instruction, said mask control field specifying when said mask is required for said graphic instruction;

reading and interpreting a count field in said graphic instruction, said count field being interpreted as a mask count if said mask control field is set to a corresponding value; and reading and interpreting a skip field in said graphic instruction, said skip field specifying a number of frame buffer memory locations to skip without manipulation.

11. The process of claim 9 wherein said step of reading and interpreting said instruction stream further comprising the steps of:

reading and interpreting a count field in said graphic instruction, said count field specifying a number of frame buffer memory locations to transfer from a source region to said frame buffer; and reading and interpreting a skip field in said graphic instruction, said skip field specifying a number of frame buffer memory locations to skip without manipulation.

12. A computer controlled display system for specifying and manipulating regions of a graphic representation, said display system comprising:

a frame buffer having a plurality of memory locations containing image data, said image data being data bits corresponding to a plurality of displayable picture elements (pixels), each of said plurality of memory locations further including at least one bit location, each bit location containing one data bit of image data;

means for providing an area description command, said area description command being information specifying a location and size of a frame buffer region in said frame buffer and specifying manipulations to said frame buffer region, said location of said frame buffer region being specifiable at any said bit location in said frame buffer, said area description command including a scan count and an instruction stream, said scan count indicating at least one scan line in said frame buffer, the scan line being operated on by said area description command, said instruction stream having at least one graphic instruction, said graphic instruction comprising a first group of bits, said first group of bits being an encoded representation of a second group of bits located in said frame buffer region, said first number of bits being less than said second number of bits;

means for reading and interpreting said area description command; and means for modifying the contents of said frame buffer in accordance with said area description command.

13. The display system of claim 12 wherein said means for reading and interpreting said area description command further comprising:

means for reading and interpreting said scan count residing within said area description command; and means for reading and interpreting said instruction stream, said instruction stream including said graphic instruction residing within said area description command.

14. The display system of claim 13 wherein said means for reading and interpreting an instruction stream further comprising:

means for reading and interpreting a stop field in said graphic instruction, said stop field specifying when processing for said area description command is complete;

means for reading and interpreting a mask residing within said graphic instruction if said graphic instruction requires said mask;

means for reading and interpreting a mask control field in said graphic instruction, said mask control field specifying when said mask is required by said graphic instruction;

means for reading and interpreting a count field in said graphic instruction, said count field being interpreted as a mask count if said mask control field is set to a corresponding value; and means for reading and interpreting a skip field in said graphic instruction, said skip field specifying a number of frame buffer memory locations to skip without manipulation.

15. The display system of claim 13 wherein said means for reading and interpreting said instruction stream further comprising:

means for reading and interpreting a stop field in said graphic instruction, said stop field specifying when processing for said area description command is complete;

means for reading and interpreting a mask control field in said graphic instruction, said mask control field specifying when a mask is required by said graphic instruction;

means for reading and interpreting a count field in said graphic instruction, said count field being interpreted as a mask count if said mask control field is set to a corresponding value; and means for reading and interpreting a skip field in said graphic instruction, said skip field specifying a number of frame buffer memory locations to skip without manipulation.

16. The display system of claim 12 wherein said means for modifying the contents of said frame buffer further comprising:

means for reading the contents of a source region in a source image buffer, said source region being defined by said area description command; and means for merging the contents of said source region into said frame buffer region in said frame buffer, said means for merging operating in accordance with said area description command, said means for merging not affecting other areas not within said frame buffer region.

17. The display system of claim 16 wherein said means for merging the contents of said source region into said frame buffer region further comprising:

means for reading the contents of said frame buffer region;

means for reading said mask from said area description command; and means for transferring bits from said source region to said frame buffer region only where corresponding bits in said mask are set to a true value.

18. The display system of claim 16 wherein said means for merging the contents of said source region into said frame buffer region further comprising:

means for transferring the contents of a number of memory locations from said source region to said frame buffer, said number corresponding to a count field residing within said area description command.

19. The display system of claim 12 wherein said area description command further including an instruction count, said means for reading and interpreting said area description command further comprising:

means for reading and interpreting said scan count residing within said area description command;

means for reading and interpreting said instruction count residing within said area description command; and means for reading and interpreting and instruction stream, the number of graphic instructions in said instruction stream corresponding to said instruction count.

20. The display system of claim 19 wherein said means for reading and interpreting said instruction stream further comprising:

means for reading and interpreting a mask residing within said graphic instruction if said graphic instruction requires said mask;

means for reading and interpreting a mask control field in said graphic instruction, said mask control field specifying when said mask is required for said graphic instruction;

means for reading and interpreting a count field in said graphic instruction, said count field being interpreted as a mask count if said mask control field is set to a corresponding value; and means for reading and interpreting a skip field in said graphic instruction, said skip field specifying a number of frame buffer memory locations to skip without manipulation.

* * * * *